United States Patent [19]

Martin

[11] Patent Number: 4,667,501

[45] Date of Patent: May 26, 1987

[54] APPARATUS FOR STRAIGHTENING ELECTRODE RODS

[75] Inventor: Robert J. Martin, Baden, Pa.

[73] Assignee: Aluminum Company of America, Pittsburgh, Pa.

[21] Appl. No.: 812,811

[22] Filed: Dec. 23, 1985

[51] Int. Cl.[4] ..... B21D 3/10; B21D 3/16

[52] U.S. Cl. ..... 72/403; 72/392; 72/394

[58] Field of Search ..... 72/392–394, 72/293, 295, 296, 302, 301, 399, 401, 407, 385, 403; 140/147

[56] References Cited

U.S. PATENT DOCUMENTS

| | | | |
|---|---|---|---|
| 1,115,612 | 11/1914 | Stillwell | 72/407 |
| 1,524,753 | 2/1925 | Schwerin | 72/407 |
| 2,705,040 | 3/1955 | Howick | 72/705 |
| 2,750,983 | 6/1956 | Rogers | 72/392 |
| 3,106,945 | 10/1963 | Wright et al. | 72/385 |
| 3,939,553 | 2/1976 | Feterl | 72/401 |
| 4,002,050 | 1/1977 | Clavin | 72/392 |
| 4,262,515 | 4/1981 | Frei | 72/302 |

FOREIGN PATENT DOCUMENTS

| | | | |
|---|---|---|---|
| 977958 | 4/1951 | France | 72/393 |

*Primary Examiner*—Daniel C. Crane
*Attorney, Agent, or Firm*—Max L. Williamson

[57] ABSTRACT

Apparatus for automatically straightening portions of a rod assembly having stubs extending outwardly from a yoke connected to the end of a rod and which is used in the electrolytic production of metals. A bent portion of the rod portion of the assembly is straightened by opposing anvils adapted for movement toward one another. As the anvils are closed together, a bent rod portion between them is straightened. The stubs which become toed-in during use are straightened by a stub straightening portion of the apparatus which is inserted between the stubs and actuated against the stubs with sufficient force to remove the toe-in. The apparatus is adapted to perform the straightening automatically on bent rod assemblies which are transported through the apparatus.

10 Claims, 9 Drawing Figures

APPARATUS FOR STRAIGHTENING ELECTRODE RODS

BACKGROUND OF THE INVENTION

This invention relates to apparatus used for straightening electrode rod or bar assemblies which are bent during use in the electrolytic production of metal. More particularly, it relates to apparatus for automatically straightening rod or bar assemblies having a structure attached to an end of a rod or bar which includes two or more stubs extending from such structure for making a connection with an electrode body.

In the electrolytic production of a metal such as aluminum, for example, electric current is passed through a molten salt bath held in a container called a pot or a cell. The molten bath includes dissolved aluminum oxide, and the current passing through the bath reduces the aluminum oxide to aluminum which is collected on the bottom of the cell. Typically, the anode used in such a process is a carbon body connected to a metal rod or bar or connected to a rod or bar assembly having a structure on the end of a rod or bar. Whether the carbon body is connected directly to the rod or bar or to stubs on a structure on the end of a rod or bar generally depends on the size of the body. It is also noted that whether a rod or bar is used is a matter of choice, and the words "rod" or "bar" may be substituted one for the other in the following description of the invention and the accompanying claims. The free end of the rod is connected to a power source and the carbon body is suspended in the molten salt bath. During the course of producing aluminum, the carbon body is consumed and must be replaced from time to time. When the bulk of the body has been consumed, a relatively small portion remains, which is called a butt, and the rod with the butt thereon is removed from the cell and replaced with a rod having a new carbon body thereon. It is desirable to strip the butt from the rod and salvage the carbon for use in making a new anode body and to reuse the rod to make a new anode assembly.

The structure and size of the rod portion of the assembly vary with the size of the cell and the anode body suspended therein. In the early days of commercially producing aluminum, the rod was simply a straight length of copper with an end embedded in the carbon block. With the advent of expanded use of aluminum and greater production demands, cells grew in size as did the size of the carbon blocks. As a consequence, the metal suspension rods have become heavier and have been adapted for effecting a more stable attachment to a carbon block than offered by embedment in a single opening. One type of anode rod in common usage today features a straight length of aluminum bar having a yoke-like structure attached to an end. The yoke is made of steel and has a pair of arms extending outwardly in radially opposing directions from a cylindrical stub member. Another cylindrical stub member is connected to the end of each arm to complete the yoke, and it is attached to the end of the bar, preferably by friction welding the center stub to the bar end. The yoked bar is then attached to the carbon block by positioning the outer stubs in slightly oversize holes in the block and filling the space between the stubs and block with molten iron to embed and retain the stubs in the holes when it solidifies. Whether the rod is simply a straight length or a yoked bar assembly, as just described, it is likely to become bent at least to some degree during usage and require straightening before being reused. An unyoked bar tends to become bent slightly above its point of embedment in the anode block when it is removed from the cell. A yoked bar will typically become bent near the connection with the center stub and, in addition, the outer stubs tend to toe inwardly due to the differences in coefficients of expansion between carbon and steel. Whether the bar is yoked or not, it must be straightened before reuse to insure that the anode block can be properly placed in the cell.

Apparatus is known to automatically straighten a length of unyoked rod. Apparatus of this kind comprises opposing power actuated clamping jaws connected to a frame. The rods are suspended from an overhead transport system which passes through the frame. The apparatus is adapted to stop a suspended rod at the proper point with respect to the jaws. One set of jaws is then actuated to straighten the rod in a direction normal to the line of travel of the suspended rod, and then the other set of jaws is actuated to straighten the rod in the direction of line of travel to complete straightening the rod.

Apparatus for automatically straightening a yoked rod and removing toe-in from the stubs has not been known, however. Heretofore, such a rod has been straightened by manual manipulation in a powered press, and toe-in of the stubs has not been removed. Such straightening procedures have been time-consuming and expensive. To allow for stub toe-in that occurs through use, a rod assembly, when first made, is made with the stubs toed outward the maximum amount acceptable to assemble with an anode block. With each successive use, the stubs toe-in an additional amount until the toe-in exceeds an amount which permits assembly with an anode block. When that amount of toe-in occurs, the rod assembly is restubbed.

SUMMARY OF THE INVENTION

Apparatus of this invention comprises a stub straightening means which is adapted for movement to a position between and away from stubs of an anode rod assembly. The stubs are used to connect a carbon block to the assembly and become toed-in during use of the assembly in the electrolytic production of a metal such as aluminum, for example. The straightening means is further adapted to be power actuated so as to contact the stubs with sufficient force to remove the toe-in and align the stubs to a desired position. According to a further development of the invention, the apparatus is adapted with a clamp means for clamping the rod assembly in a predetermined position and means for straightening a bar portion of the assembly after being clamped in the predetermined position. In yet a further development of the invention, the apparatus may be adapted for automatic operation in removing the stub toe-in and straightening the bar portion.

It is thus an objective of this invention to provide apparatus which automatically straightens a bar portion and eliminates toe-in between the stubs of an anode rod assembly having a yoke with stubs extending therefrom connected to an end of a bar.

It is a further objective that the apparatus may be operated automatically in straightening the bar and removing stub toe-in.

This and other objectives and advantages will be apparent with reference to the following description of a preferred embodiment of the invention and the accompanying drawings.

DESCRIPTION OF A PREFERRED EMBODIMENT

Figure 1:
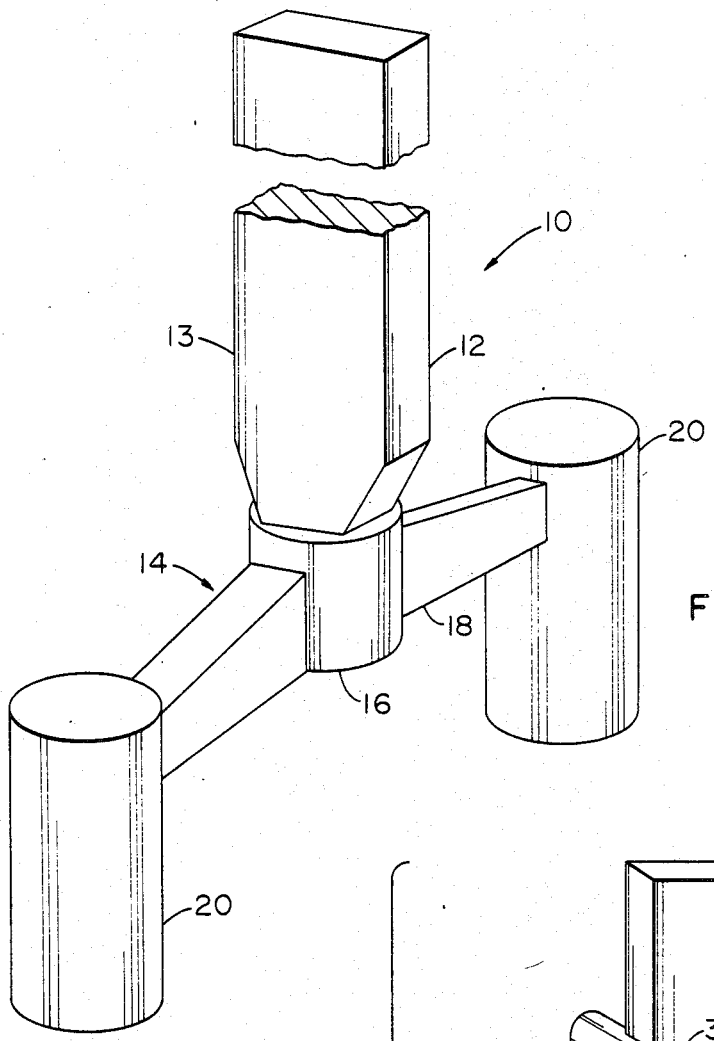
FIG. 1 is a perspective view of a rod assembly that may be straightened by apparatus of this invention.

An anode rod assembly 10 for suspending a carbon anode in an electrolytic cell to produce aluminum is as shown in FIG. 1. An anode bar 12, which is typically aluminum and rectangular in cross section, is typically friction welded to a triple stub steel yoke 14. The yoke 14 has a central cylindrical stub 16, opposing stub arms 18 extending radially outwardly from the central stub in a direction normal to the longest face 13 of the rod 12, and a pair of outer cylindrical stubs 20, 20 welded to the distal ends of the stub arms with their axes parallel to the central stub axis. To use the rod assembly, the outer stubs 20, 20 are embedded in a carbon anode block; then the assembly 10, with the carbon block attached thereto, is positioned over an electrolytic cell with the carbon immersed in a molten salt bath in the cell. As current is passed through the rod assembly 10, alumina dissolved in the molten salt is reduced to produce metallic aluminum and the carbon is oxidized and consumed. As has been noted heretofore, the rod 12 tends to become bent near its connection with the stub 16 when it becomes necessary to remove the rod assembly 10 from the cell to replace it with a rod assembly having a new carbon block thereon. In addition to bending of the rod 12, the assembly becomes further distorted during use from toeing-in of the ends of the outer stubs 20, 20. Toeing-in is because of the difference in thermal expansion characteristics of the carbon block and the steel components of the yoke 14. In order to reuse a rod assembly 10, the bent portions of the rod 12 must be straightened and useful life of the rod assembly can be extended by removing the toe-in between the stubs 20, 20.

A preferred embodiment of this invention is comprised of three separate units or parts which cooperate in operation of the invention to restore a rod assembly, such as that just described, to its original working order. The three units of this invention are a fixed anvil unit, a movable anvil unit, and a stub straightening unit, which are supported and positioned on a frame in the proper relationship with one another to effect straightening of a bar portion of the rod assembly and removing toe-in between stubs.

Figure 2:
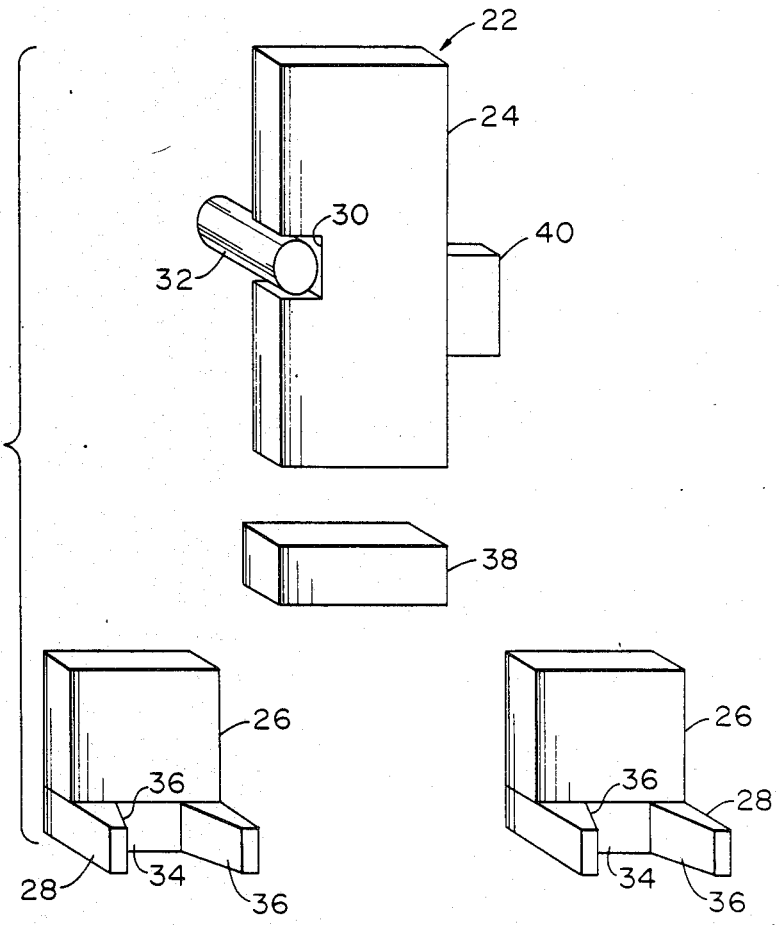
FIG. 2 is a perspective view of a fixed anvil unit portion of apparatus of this invention.

Referring now to FIG. 2, the fixed anvil unit 22 is comprised of an upper anvil 24, a pair of lower anvils 26, and a pair of V-blocks 28. The upper anvil 24 is rectangular and made from relatively heavy steel plate, such as one-inch thick, for example, and it is rigidly attached to a frame member (not shown). A notch 30 projecting inwardly from a side of the anvil is provided to accommodate a movable rod stop 32, which will be discussed later.

Lower anvils 26 are also rectangular and made from relatively heavy steel plate and are rigidly attached to the same frame supporting the upper anvil 24 with their surfaces outward from the frame in the same plane as the outer surface of the upper anvil 24.

The V-blocks are also attached to the frame below the lower anvils 26 and have V-shaped openings 34 extending outwardly from the plane of the outer surfaces of the lower anvils.

The upper anvil 24, lower anvils 26 and V-blocks 28 are all positioned on the frame (not shown) in relationship with each other so that a straight anode assembly 10 in suspension adjacent thereto will have a lower portion of the stubs 20 contacting the sloping surfaces 36 of the V-blocks 28, an upper portion of the stubs 20 in contact with the lower anvils 26 and a portion of the bar 12 above the yoke 18 in contact with the upper anvil 24.

FIG. 2 also shows a central stub support 38 below the fixed anvil 24 and a movable anti-backup plate 40 on the side of the fixed anvil 24 opposite the side having the rod stop 32. The stub support 38 is spring mounted to the frame at a position to contact the central stub 16 when an anode assembly 10 is suspended as just described. The anti-backup plate 40 can be moved to extend beyond the front face of the anvil 24 or retracted behind it. The operation and purpose of the central stub support 38 and anti-backup plate 40 will be described later.

Figure 3:
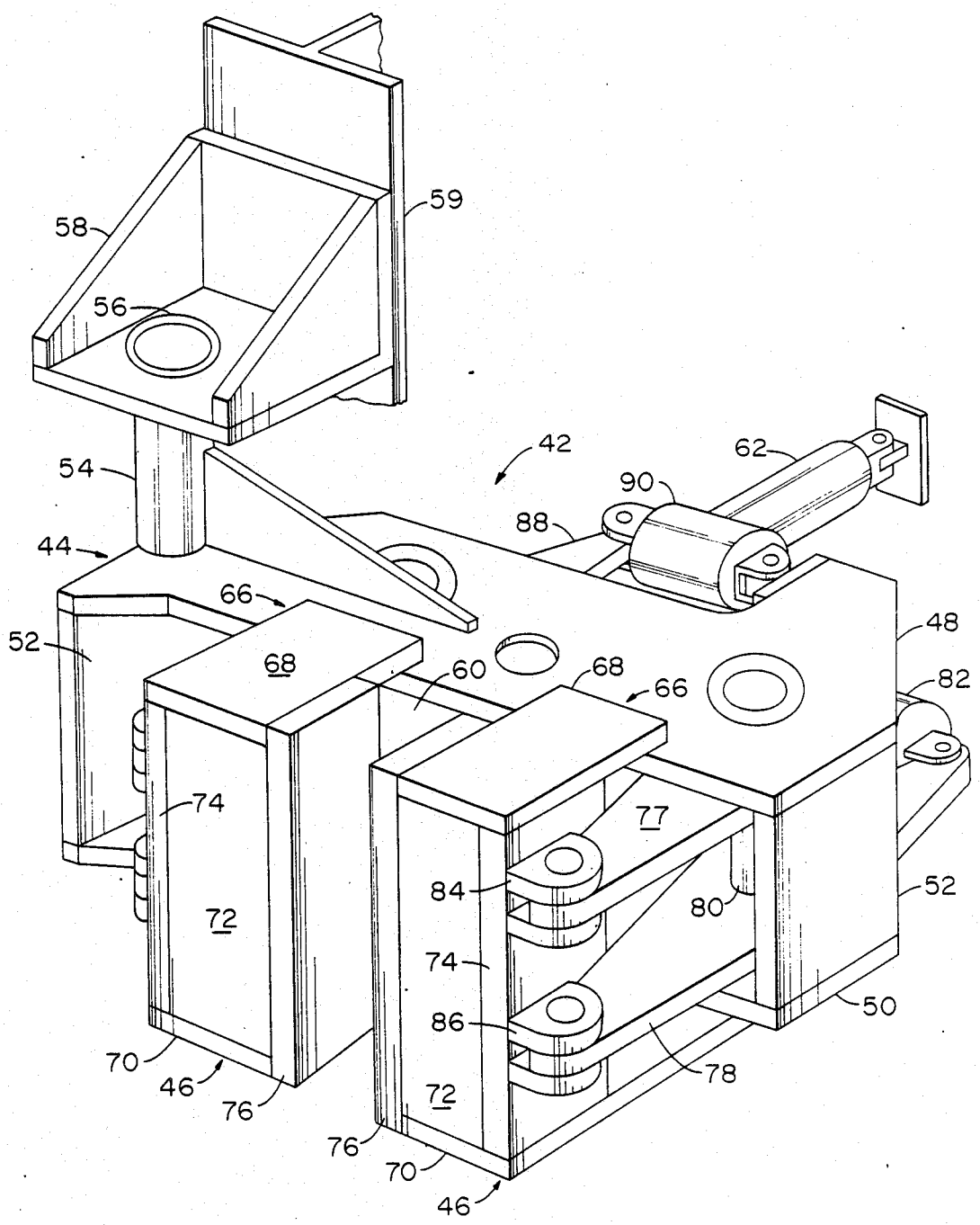
FIG. 3 is a perspective view of a movable anvil unit portion of apparatus of this invention.

The movable unit 42 will now be described with reference to FIG. 3. The unit includes a hinged anvil 44 and opposing reciprocating side anvils 46. The hinged anvil 44 is an assembly of plate shapes adapted to function as a mount for the reciprocating side anvils 46 and to straighten a bar portion of an anode rod in a direction normal to the direction of travel of the rod assembly through the apparatus, as will be explained later. The hinged anvil 44 has a top support plate 48 and a bottom support plate 50 spaced apart and assembled together by welding spacer plates 52 between them. A hinge pin sleeve 54 is provided adjacent one end of the welded plate assembly to house a hinge pin 56 which assembles with brackets 58 (lower bracket 58 not shown in FIG. 3) attached to the frame 59. The hinged anvil 44 also has an anode bar wear plate 60 attached to the leading edges of the top and bottom support plates 48, 50 for the purpose of contacting and straightening a bar portion of an anode rod assembly in a direction normal to the direction of the line of travel of the assembly through the apparatus, as will be described later.

The brackets 58 are attached to the frame 59 at a location which enables hinging the anvil unit 42 about the hinge pin 56 and position the anode wear plate 60 in a position referred to as closed which is parallel to and spaced away from the upper anvil 24 a predetermined distance. From the closed position, the unit can also be hinged to an open position to enable entry of an anode rod assembly into the apparatus for restoration to its original order, as will be discussed later. A hydraulic cylinder 62, having one end pivotably attached to the frame (not shown), has a piston rod extending from the opposite end of the cylinder which is pivotably attached to the hingeable anvil 44. The hydraulic cylinder 62 provides the force to rotate the unit about its hinged connection.

The reciprocating side anvils 46 are attached to the hinged anvil 44 in a manner which enables them to be moved toward and away from each other to straighten a portion of the bar 12 in a direction coincident with the line of travel of the rod assembly through the apparatus. Each side anvil 46 includes a channel-shaped plate assembly 66 projecting outwardly from the side of the hinged anvil 44 having the wear plate 60 attached thereto. Each channel-shaped assembly 66 is comprised of a top plate 68, a bottom plate 70, a spacer plate 72 connecting the leading edges of the top and bottom plate 68, 70, and a bracket plate 74 connecting the outer side edges of the top and bottom plates 68, 70 adjacent the spacer plate. Side wear plates 76 are attached to the inner side edges of the top and bottom plates 68, 70.

The channel-shaped assemblies 66 are attached to the hinged anvil 44 on each side of the wear plate 60 with a hydraulic linkage system so that the side wear plates 76 may be moved toward and away from one another across the face of the hinged anvil wear plate 60. The hydraulic linkage system for each side anvil includes upper and lower pivotable arms 77, 78. The lower arm 78 of the side anvil 46 furthest from the hinged anvil hinge has one end pivotably connected to the piston rod of a hydraulic cylinder 82 and the other end pin connected to a bottom bracket 86 on the side anvil bracket plate 74. The opposite end of the cylinder 82 is attached to the bottom plate 50 of the hinged anvil 44. The upper arm 77 of the side anvil 46 furthest from the hinged anvil hinge is shorter in length than the lower arm 78 and has one end connected to an upper side anvil bracket 84 and the other end connected to a pin 80 which passes through the center of arm 78 and has its ends connected to the top and bottom plates 48, 50.

The channel-shaped assembly 66 nearest the hinged anvil hinge is identically connected to the hinged anvil except that the upper arm 88 is the long arm and is connected to a hydraulic cylinder 90 attached to the top plate 48 of the hinged anvil 44.

With the side anvils thus attached to the hinged anvil 44, the side anvil plates 76 can be selectively moved toward and away from one another by activation of the hydraulic cylinders.

Figure 4:
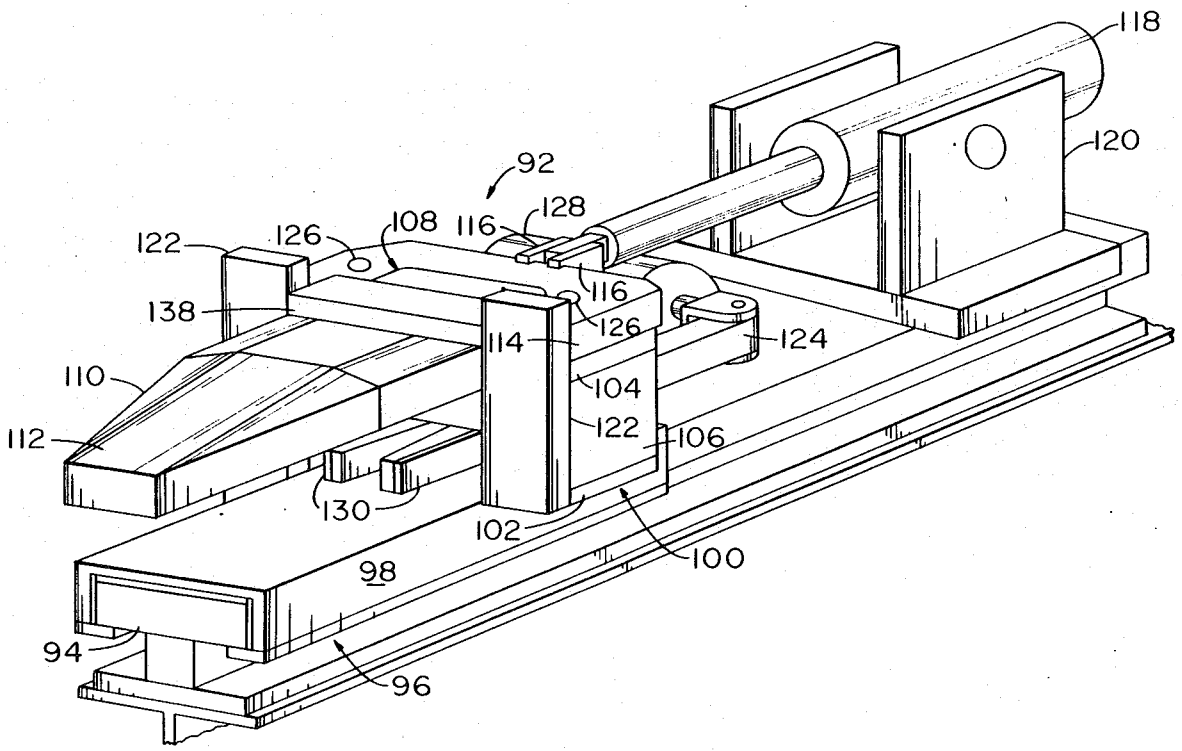
FIG. 4 is a perspective view of a stub straightening unit portion of apparatus of this invention.
Figure 6:
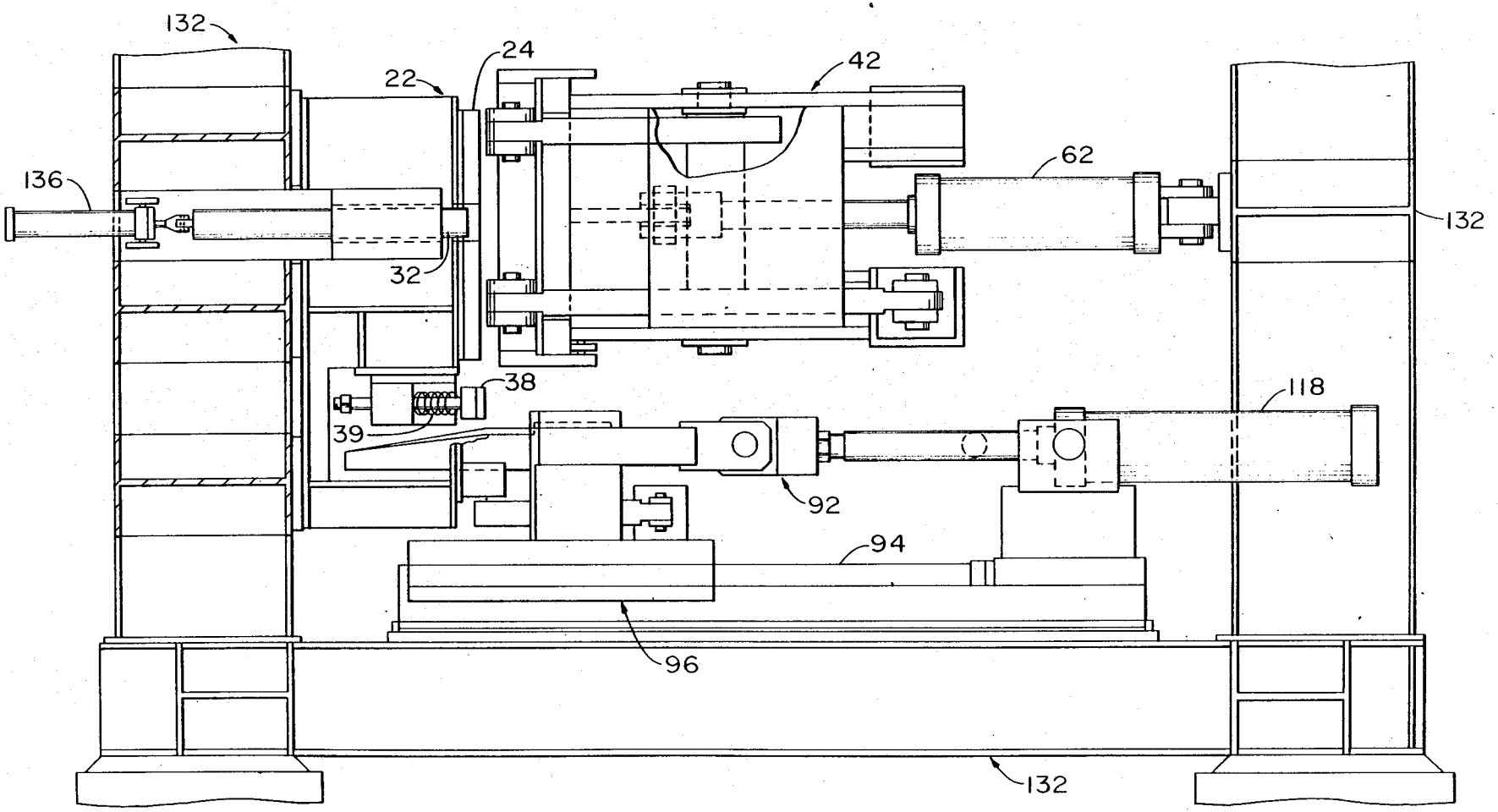
FIG. 6 is a side elevation view of apparatus of this invention.
Figure 7:
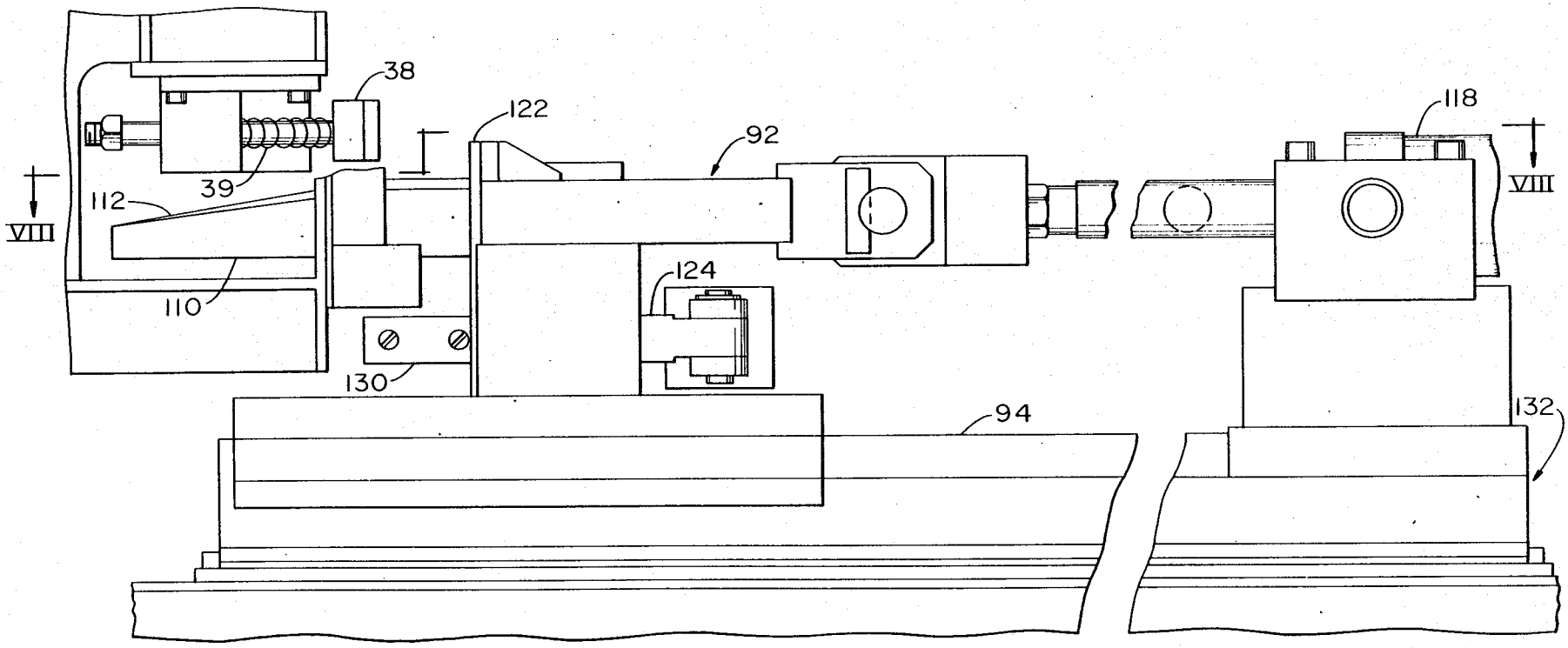
FIG. 7 is a side elevation view of the stub straightening unit portion of apparatus of this invention.
Figure 8:
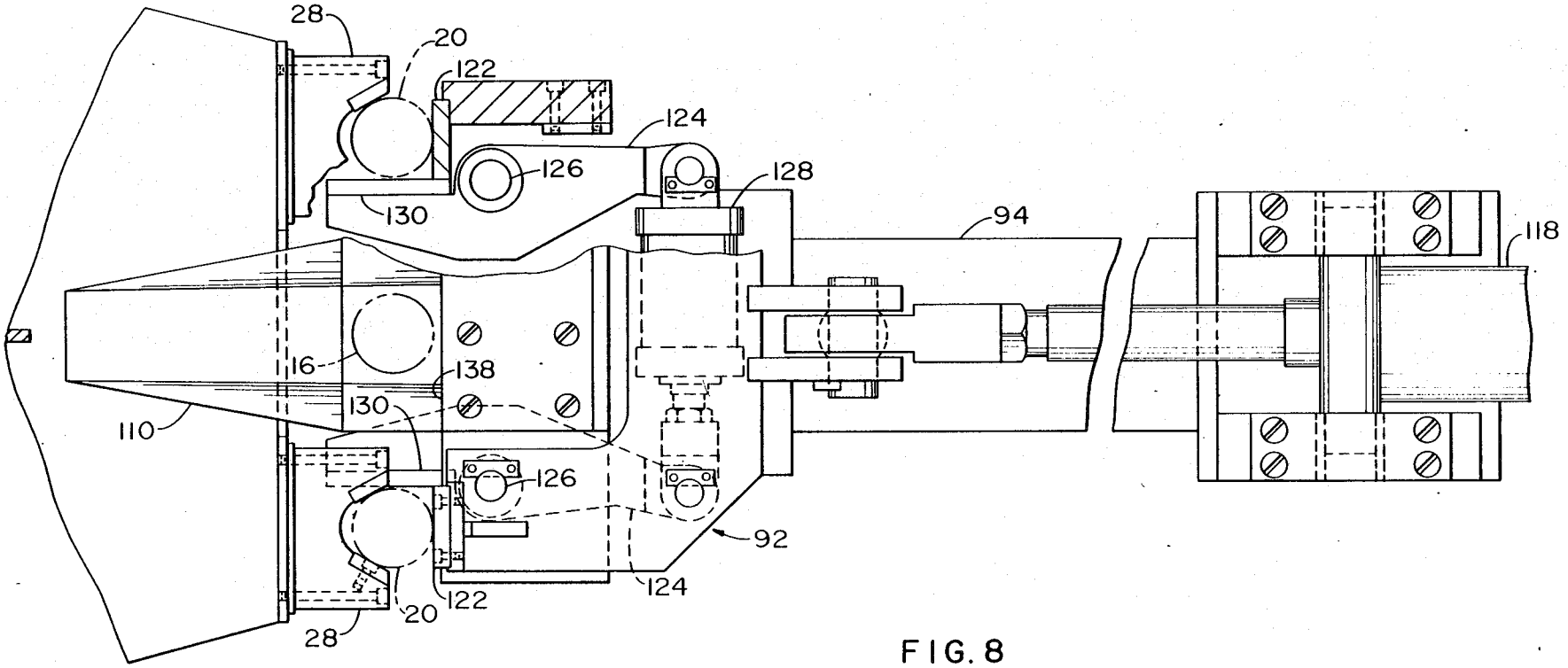
FIG. 8 is a plan view of the stub straightening unit portion of apparatus of this invention.
Figure 9:
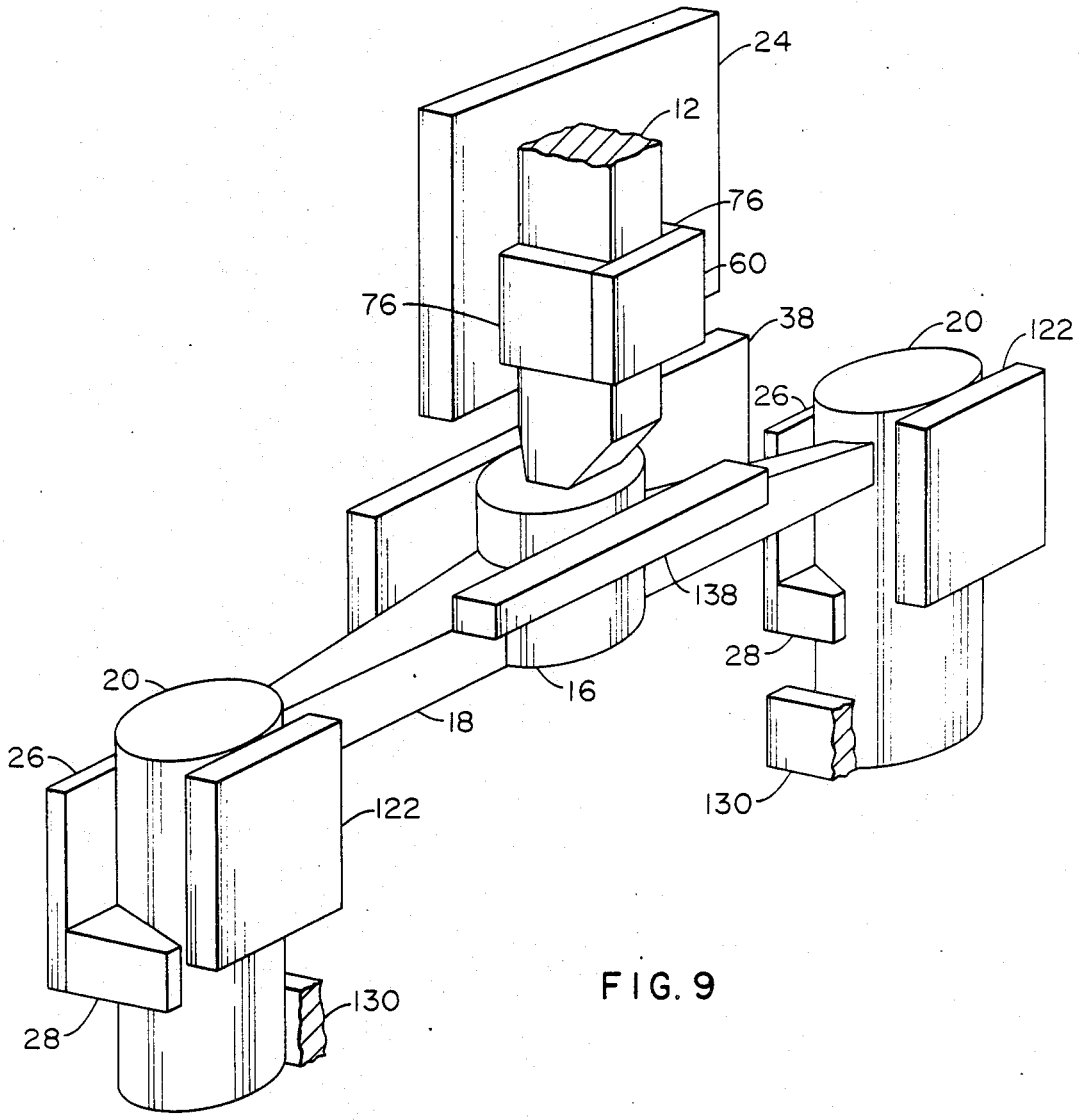
FIG. 9 is perspective view of a rod assembly clamped in apparatus of this invention and schematically shows elements of the stub straightening unit and the anvil units in contact with portions of the assembly to effect straightening thereof.

The stub straightening unit 92, shown in FIG. 4, is slidably mounted on a part of the frame below the movable anvil unit 42. A T-shaped support 94 is attached to the frame to support the unit. A slidable mount 96 has a channel portion 98 adapted to slide longitudinally along the flange of the T. A rectangular-shaped box-like housing 100 is assembled from a bottom plate 102, a top plate 104, and side plates 106 connecting the top and bottom plates together. The bottom plate 102 of the housing 100 is fastened to the flange of the channel 98, and a stub insert 108 is attached to the top plate 104. The stub insert 108 has a forwardly projecting nose 110 which tapers inwardly in width from back to front and has an upper surface 112 which slopes downwardly from back to front. A cover plate 114 which is notched to fit around the back end of the stub insert 108 is also attached to the top plate 104 of the housing 100. Brackets 116 on the back edge of the cover plate are provided for connection with the piston rod of the hydraulic cylinder 118 mounted in a cylinder housing 120 on the back end of the T 94. As shown in FIGS. 6, 7 and 8, the stub unit is in a forward or advanced position, and by activating the hydraulic cylinder 118, it can be made to slide along the T 94 rearwardly toward the cylinder. Clamp plates 122 are attached outwardly of the stub nose 110 to the forward edges of the housing 100 and cover plate 114 to cooperate with portions of the fixed anvil unit 22 to clamp an anode rod assembly in a desired position, as will be explained later. A pair of stub straightening arms 124 are rotatably mounted on pins 126 extending through the housing 100 on both sides of the stub insert 108, as may best be seen in FIG. 8. The rear of one arm is attached to an end of a hydraulic cylinder 128 mounted on the channel 98, and the rear of the other arm is attached to the piston rod of the cylinder. Attached to a forward end portion of each arm is a wear plate 130 for contacting the inside surface of the outer stubs on an anode bar assembly to straighten them. By actuating the hydraulic cylinder, the arms are pivoted about the pins 126 and the wear plates 130 are moved toward or away from the stub nose 110.

Figure 5:
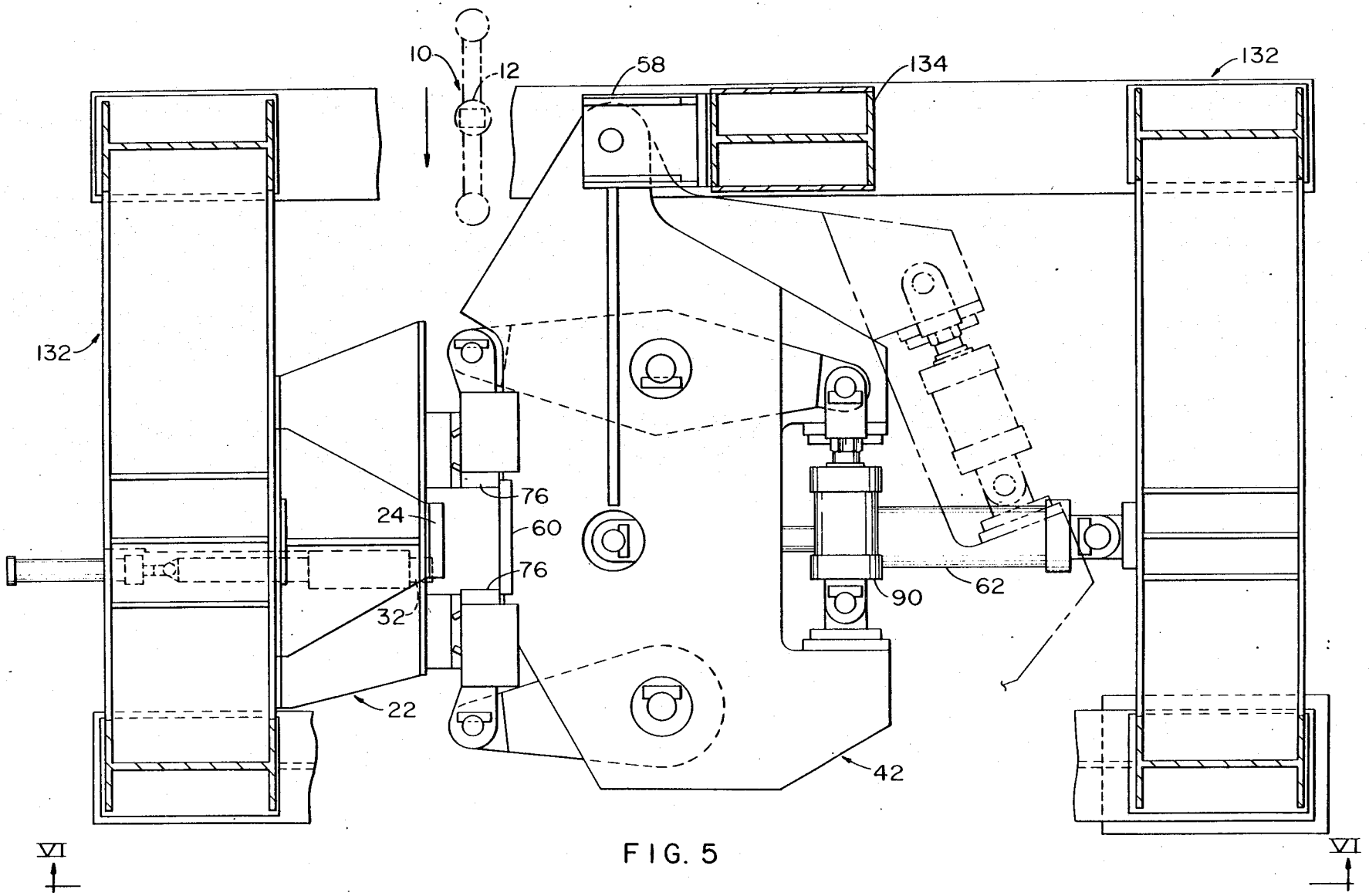
FIG. 5 is a plan view of apparatus of this invention.

The fixed anvil unit 22, movable anvil unit 42, and stub straightening unit 92, as just described, are mounted on a frame in predetermined positions so as to be operated automatically as apparatus in straightening anode rod assemblies suspended from an overhead conveyor system. In FIG. 5, an anode assembly 10 is shown in dashed lines on the entry side of the apparatus and the line of travel is indicated by the arrow. As may be seen in FIGS. 5 and 6, the fixed anvil unit 22 is attached to the frame 132 adjacent to and on one side of the line of travel. The movable anvil unit 42 is shown in its closed position with the anode bar wear plate 60 parallel with the upper fixed anvil 24. The distance between the faces of the two plates 24, 60 is equal to the depth of bar surface 13. In order to enable positioning the bar wear plate 60 of the movable anvil unit 42 in the closed position, a frame member 134 is provided at the proper location for attachment of the brackets 58 which anchor the hinge pin 56 in the hinge pin sleeve 54. As partially shown in dashed lines in FIG. 5, the movable unit 42 can be pivoted about the hinged connection to an open position which permits movement of the anode bar assembly into the apparatus for straightening.

Referring now to FIGS. 7 and 8, the stub straightening unit 92 is shown in its most extended forward position with the clamp plates 122 pressing against outer stubs 20 (shown in dashed lines in FIG. 8) seated in the V-blocks 28, and the stub nose 110 projects between the outer stubs. By actuating the hydraulic cylinder 118, the stub unit 92 can be slid along the T-support 94 and retracted a distance sufficient to clear the nose 110 from between the outer stubs to enable movement of the anode assembly out of the apparatus.

Operation of the apparatus will now be explained with reference to FIGS. 5, 6, 7, 8 and 9. At the beginning of the cycle, as the rod assembly 10 suspended from an overhead conveyor approaches the apparatus, the movable anvil unit 42 is in the open position shown in dashed lines in FIG. 5. The stub straightening unit 92 is in a retracted position with the slidable mount 96 toward the rear end of the T-support 94 and the stub nose 110 clear of the line of travel of the rod assembly. Prior to the rod assembly 10 entering the apparatus, the trolley carrying the assembly strikes a switch which actuates the rod stop hydraulic cylinder 136 causing the rod stop 32 to extend outwardly from the upper fixed anvil 24 across the line of travel of the rod assembly. At the point of the anode rod 12 contacting the rod stop, another switch is tripped actuating a hydraulic cylinder which extends the anti-backup plate 40 (FIG. 2) beyond the face of the upper anvil 24 to prevent the anode rod assembly from backing up or swinging. After a momentary delay, the anti-backup plate is retracted and hydraulic cylinder 118 is actuated to advance the stub straightening unit 92 along the T-support 94. As the stub straightening unit 92 advances, the stub nose 110 passes between the outer stubs 20 and the sloping surface 112 contacts the bottom of the center stub 16. Continuing movement of the nose 110 carries the bar 12 of the rod assembly 10 against the upper anvil 24 and causes the assembly to ride up the tapered nose, bringing the stub straightening arm wear plates 130 into position between the stubs 20. Actuation of hydraulic cylinder 128 causes the arms 124 to rotate about pins 126 and force the wear plates 130 to move a predetermined amount and remove any toe-in of the stubs which may be present causing the stubs to be properly aligned with their axes parallel. Concurrent with removal of the toe-in, clamp plates 122 are in contact with stubs 20 and removal of the toe-in enables clamping the stubs in the V-blocks 28. With the assembly 10 firmly clamped in the apparatus, the rod stop 32 is withdrawn from its extended position. It is also noted that when the outer stubs 20 are clamped firmly in the V-blocks, the stub ledge 138 at the rear of the nose 110 of the stub insert 108 is tight against the center stub 16 of the anode assembly forcing the central stub support 38 to compress the springs 39 around the stub support mounting bolts. Loading the springs 39 is helpful in clearing the assembly from its clamped position after straightening.

With the toe-in between the stubs removed and the assembly firmly clamped in position with the stub insert unit, the apparatus can be actuated to remove any bends which may be present in the bar 12. As has been noted before, the bar is typically bent just above the central stub in a direction transverse to the line of travel of the rod assembly through the apparatus. The first operation after clamping the assembly is actuation of the movable hinge hydraulic cylinder 62. As the hinged unit 42 swings toward the closed position shown in FIG. 5, the anode bar wear plate 60 contacts the bar and forces it against the upper anvil 24 straightening any bend which might be present in a direction normal to the direction of travel of the assembly through the apparatus. After maintaining the straightening pressure momentarily, it is relieved, but the wear plate 60 is maintained in light contact with the bar. Next, side anvil upper cylinder 90 is activated moving side wear plate 76 in the direction of travel of the assembly through the apparatus until it has reached its fully closed position. The bottom cylinder 82 is then activated moving the opposing side wear plate 76 in a direction opposite the direction of travel of the assembly through the apparatus until the bar is pressed firmly against the first side wear plate and thereby becomes straightened.

After the side anvils 46 have been held in position momentarily at their full pressure, the side anvils 46 are retracted and immediately thereafter the movable unit 42 is hinged away from the bar and the stub straightening unit 92 is withdrawn. It is noted that timing of the movements of the movable unit 42 and the stub unit 92 is important to prevent the straightened assembly from swinging violently after release from its clamped position. Full opening of the movable unit 42 is delayed a sufficient length of time to insure that the stub nose 110 is cleared from under the central stub 16 and between the outer stubs 20. Concurrent with opening the apparatus to enable free suspension of the assembly from the overhead conveyor, the compressed central stub support springs 39 force the stub support 38 outward, pushing the assembly away from the fixed anvil unit 22 and insuring that the assembly is free to be moved out of the apparatus.

While the invention has been described in terms of preferred embodiments, the claims appended hereto are intended to encompass all embodiments which fall within the spirit of the invention.

What is claimed is:

1. Apparatus for straightening an anode rod assembly, comprising:

a frame;

clamping means on the frame to hold an anode rod assembly in a fixed position with respect to the frame, the assembly having stubs extending outwardly from a yoke connected to the end of a rod;

stub straightening means mounted on a support in a manner to enable selective movement to and away from a position between the stubs;

means on the stub straightening means for applying a sufficient force against the stubs to remove stub toe-in and align the stubs substantially parallel to one another; and rod straightening means supported on the apparatus in a position which enables such means to contact at least a portion of the rod with a force sufficient to straighten it.

2. Apparatus as claimed in claim 1 wherein the stub straightening means is slidably attached to the support.

3. Apparatus as claimed in claim 1 wherein the stub straightening means includes a pair of arms with each adapted to pivot so that an end of each arm contacts at least a portion of one of the stubs to bend the stub from application of force to opposing ends of each arm.

4. Apparatus as claimed in claim 1 which further includes V-blocks attached to the frame to provide a seat for at least a portion of each of the stubs after toe-in of the stubs has been removed therefrom to prevent lateral movement thereof.

5. Apparatus as claimed in claim 4 which further includes means on the stub straightening means for clamping the stubs in a fixed position in the V-blocks.

6. Apparatus as claimed in claim 4 which further includes means on the stub straightening means for seating the stubs in the V-blocks after toe-in has been removed from the stubs.

7. Apparatus as claimed in claim 1 wherein the means for straightening a portion of the rod of a rod assembly clamped in a fixed position with respect to the frame includes a pair of anvils adapted to contact opposing surface portions of the rod lying in planes which are substantially parallel to a plane passing through the rod assembly stubs and the anvils are further adapted for relative movement toward and away from each other to apply a force sufficient to straighten a portion of the rod between the anvils.

8. Apparatus as claimed in claim 7 wherein one of the anvils is fixed to a support and the other of the pair is attached to a hinged support so that the anvil thereon can be hinged from an open position to and opposing the fixed anvil to straighten a rod between the anvils.

9. Apparatus as claimed in claim 1 wherein the means for straightening a portion of the rod of a rod assembly clamped in a fixed position with respect to the frame includes a pair of anvils which are adapted to contact opposing surface portions of the rod lying in planes which are substantially normal to a plane passing through the rod assembly stubs and the anvils are further adapted for relative movement toward and away from each other to apply a force sufficient to straighten a portion of the rod between the anvils.

10. Apparatus for straightening a rod assembly having a pair of stubs extending outwardly from a yoke connected to the end of a rod, comprising:

a stub spreading unit slidably attached to a support and having a stub spreading means thereon for insertion between the stubs of a rod assembly positioned within the apparatus and removing toe-in from the stubs;

clamp means to clamp the assembly in a fixed position in the apparatus;

a fixed anvil attached to a support in a position to provide contact for a surface portion of the rod of the rod assembly held in position by the clamp means;

a first movable anvil attached to a support positioned with respect to the fixed anvil so that it may be moved toward and away from the fixed anvil with sufficient force to straighten a rod portion between the two anvils when the movable anvil is moved toward the fixed anvil; and opposing side anvils supported in a manner that they may be moved towards one another in a direction normal to the direction of straightening by the first movable and fixed anvils and contact a portion of the rod between them with sufficient force to straighten such portion.

* * * * *